US011740573B2

(12) United States Patent
Takematsu et al.

(10) Patent No.: US 11,740,573 B2
(45) Date of Patent: Aug. 29, 2023

(54) FIXING APPARATUS HAVING STAY MEMBERS FOR MAINTAINING ALIGNMENT OF ROTATABLE MEMBERS THEREOF

(71) Applicant: CANON KABUSHIKI KAISHA, Tokyo (JP)

(72) Inventors: Koji Takematsu, Chiba (JP); Tatsuo Yasui, Saitama (JP); Keiichi Mizukami, Tokyo (JP); Takuya Hasegawa, Tokyo (JP); Tomoaki Tanto, Chiba (JP); Kazuki Tada, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/544,765

(22) Filed: Dec. 7, 2021

(65) Prior Publication Data

US 2022/0253009 A1 Aug. 11, 2022

(30) Foreign Application Priority Data

Feb. 9, 2021 (JP) ..... 2021-019121

(51) Int. Cl.
*G03G 15/20* (2006.01)
*G03G 21/16* (2006.01)

(52) U.S. Cl.
CPC ..... *G03G 15/2017* (2013.01); *G03G 15/2064* (2013.01); *G03G 21/1685* (2013.01); *G03G 15/2053* (2013.01); *G03G 2215/2035* (2013.01); *G03G 2221/1639* (2013.01)

(58) Field of Classification Search
CPC ..... G03G 15/2017; G03G 15/2064; G03G 21/1685; G03G 2221/1639; G03G 2215/2035
USPC ..... 399/122, 328
See application file for complete search history.

(56) References Cited

U.S. PATENT DOCUMENTS

| | | | |
|---|---|---|---|
| 7,199,339 B2 | 4/2007 | Shirakata et al. | 219/619 |
| 7,271,371 B2 | 9/2007 | Takematsu et al. | 219/619 |
| 7,319,210 B2 | 1/2008 | Hosoi et al. | 219/619 |
| 7,397,017 B2 | 7/2008 | Hosoi et al. | 219/619 |

(Continued)

FOREIGN PATENT DOCUMENTS

JP H09-6157 1/1997

OTHER PUBLICATIONS

U.S. Appl. No. 17/544,838, filed Dec. 7, 2021.

*Primary Examiner* — Robert B Beatty
(74) *Attorney, Agent, or Firm* — Venable LLP

(57) ABSTRACT

A fixing device includes a first rotatable member with a heater, a second rotatable member contacting the first rotatable member and forming a fixing nip, a pressing unit pressing the first rotatable member to the second rotatable member in a pressing direction, a pair of side boards disposed with a space in the widthwise direction, and first, second and third stays supporting the pair of side boards. The first stay is provided upstream of a center of the fixing nip in the pressing direction and upstream of the center in a feeding direction of a recording material. The second stay is provided upstream of the center in the pressing direction and downstream of the center in the feeding direction. The third stay is provided downstream of the center in the pressing direction and at least one of upstream and downstream of the center in the feeding direction.

14 Claims, 9 Drawing Sheets

(56) References Cited

U.S. PATENT DOCUMENTS

| | | | | |
|---|---|---|---|---|
| 7,442,905 | B2 | 10/2008 | Wakahara et al. | 219/619 |
| 7,462,804 | B2 | 12/2008 | Shirakata et al. | 219/619 |
| 7,465,906 | B2 | 12/2008 | Wakahara et al. | 219/619 |
| 7,657,217 | B2 | 2/2010 | Wakahara et al. | 399/330 |
| 8,843,042 | B2 | 9/2014 | Nawa et al. | 399/328 |
| 8,843,046 | B2 | 9/2014 | Nawa et al. | 399/330 |
| 8,918,044 | B2 | 12/2014 | Takematsu et al. | 399/330 |
| 9,020,410 | B2 | 4/2015 | Hasegawa | 399/329 |
| 9,104,148 | B2 | 8/2015 | Hasegawa | G03G 15/2053 |
| 9,195,180 | B2 | 11/2015 | Hasegawa | G03G 15/2014 |
| 9,195,182 | B2 | 11/2015 | Tanto et al. | G03G 15/2025 |
| 9,195,192 | B2 | 11/2015 | Hasegawa | G03G 15/2017 |
| 9,235,167 | B2 | 1/2016 | Hasegawa | G03G 15/2017 |
| 9,280,102 | B2 | 3/2016 | Hasegawa | G03G 15/2039 |
| 9,372,448 | B2 | 6/2016 | Hasegawa | G03G 15/2032 |
| 9,517,888 | B2 | 12/2016 | Takematsu et al. | G03G 15/2053 |
| 9,541,869 | B2 | 1/2017 | Hasegawa | G03G 15/2017 |
| 9,811,038 | B2 | 11/2017 | Tanto | G03G 15/55 |
| 10,274,889 | B2 | 4/2019 | Tanto | G03G 15/206 |
| 10,379,471 | B2 | 8/2019 | Takematsu et al. | G03G 15/206 |
| 10,520,862 | B2 | 12/2019 | Hasegawa et al. | G03G 21/206 |
| 10,564,576 | B2 | 2/2020 | Tanaka et al. | G03G 15/2053 |
| 10,719,042 | B2 | 7/2020 | Hirayama et al. | G03G 15/2039 |
| 10,732,568 | B2 | 8/2020 | Hasegawa | G03G 21/206 |
| 10,795,294 | B2 | 10/2020 | Tanto | G03G 15/2053 |
| 10,969,719 | B2 * | 4/2021 | Handa | G03G 15/2064 |
| 2003/0210923 | A1 * | 11/2003 | Pirwitz | G03G 15/2064 399/122 |
| 2008/0273905 | A1 | 11/2008 | Hosoi et al. | 399/335 |
| 2009/0020524 | A1 | 1/2009 | Wakahara et al. | 219/635 |
| 2011/0064493 | A1 * | 3/2011 | Muramatsu | G03G 15/2064 399/329 |
| 2018/0157199 | A1 * | 6/2018 | Onishi | G03G 15/2032 |
| 2018/0164724 | A1 * | 6/2018 | Ogasawara | G03G 15/2053 |
| 2018/0224777 | A1 * | 8/2018 | Hashimoto | G03G 15/2053 |
| 2018/0284670 | A1 * | 10/2018 | Takematsu | G03G 15/206 |
| 2020/0159154 | A1 | 5/2020 | Tanaka et al. | G03G 21/1685 |

* cited by examiner

FIXING APPARATUS HAVING STAY MEMBERS FOR MAINTAINING ALIGNMENT OF ROTATABLE MEMBERS THEREOF

FIELD OF THE INVENTION AND RELATED ART

The present invention relates to a fixing apparatus which is ideally suitable to be employed by an electrophotographic image forming apparatus such as a printer, a copying machine, a facsimileing machine, a multifunction machine, etc.

An image forming apparatus forms an unfixed toner image on a sheet of recording medium. Then, it fixes the toner image to the sheet with the use of its fixing apparatus. The fixing apparatus has a fixation film and a pressure roller. The fixation film is heated by a heater or the like. The pressure roller forms a nip (fixation nip) by being pressed upon the fixation film. The fixing apparatus is structured so that while a sheet of recording medium having an unfixed toner image is conveyed through its fixation nip, it applies heat and pressure to the sheet and the unfixed toner image thereon to fix the toner image to the sheet. More specifically, the fixing apparatus is also provided with a pair of film guides (which sometimes is referred to as flanges) which are positioned at the widthwise ends, one for one, of the fixation film. The fixation nip is formed as the pair of film guides are pressed toward the pressure roller (Japanese Laid-open Patent Application No. H09-6157).

In the past, a fixing apparatus was structured like the one disclosed in Japanese Laid-open Patent Application No. H09-6157. That is, it was provided with a bottom board (which sometimes is referred to as base board) and a pair of side boards which are perpendicularly held to the bottom board to be enabled to keep the film guide toward the pressure roller. Further, this pair of side boards is provided with a pair of bearings, one for one, for rotatably supporting the pressure roller (more specifically, rotational axle of pressure roller).

By the way, in order to prevent the problem that while a sheet of recording medium is conveyed (while remaining pinched by fixation film and pressure roller) through the fixation nip, the sheet becomes askew, it is necessary that the fixation film and pressure roller remain aligned relative to each other at a preset level (parallelness). One of the reasons why the fixation film and pressure roller become misaligned with each other is as follows: As the film guide is pressed downward toward the pressure roller, the side board is also pressed by this downward force, being thereby deformed and/or twisted. In the past, in order to prevent this problem, side boards which were formed of relatively thick metallic substance, and therefore unlikely to be deformed or twisted by the aforementioned force, were used. This solution, however, increases a fixing apparatus in weight, being therefore against recent public desire to reduce a fixing apparatus in weight, and also, increases a fixing apparatus in cost.

The present invention was made in consideration of these issues described above. Thus, the primary objective of the present invention is to provided a fixing apparatus, which is simple in structure, and yet, can keep its fixation film and pressure roller aligned with each other at a preset level.

SUMMARY OF THE INVENTION

According to an aspect of the present invention, there is provided a fixing device comprising: a first rotatable member; a heating unit configured to heat said first rotatable member; a second rotatable member contacting an outer peripheral surface of said first rotatable member, said second rotatable member forming a fixing nip, in cooperation with said first rotatable member, configured to nip and feed a recording material, and to form a fixing nip portion for fixing a toner image by application of heat and pressure; a first supporting member configured to rotatably support said first rotatable member at both end portions thereof with respect to a widthwise direction crossing a feeding direction of the recoding material at said fixing nip portion; a second supporting member configured to rotatably support said second rotatable member at both end portions thereof with respect to the widthwise direction; a pressing unit configured to press said first rotatable member to said second rotatable member in a pressing direction where said first supporting member moves toward said second supporting member; a pair of side boards disposed with a space in the widthwise direction, the pair of side boards holing said second supporting member and a slot being formed therein to movably hold said first supporting member toward said second supporting member; and a plurality of stay members including a first stay member, a second stay member and a third stay member configured to support the pair of side boards; wherein said first stay member is provided upstream of a center of said fixing nip portion with respect to the pressing direction and upstream of the center with respect to the feeding direction, wherein said second stay member is provided upstream of the center with respect to the pressing direction and downstream of the center with respect to the feeding direction, and wherein said third stay member is provided downstream of the center with respect to the pressing direction and at least one of upstream and downstream of the center with respect to the feeding direction.

Further features of the present invention will become apparent from the following description of exemplary embodiments (with reference to the attached drawings).

Figure 9:
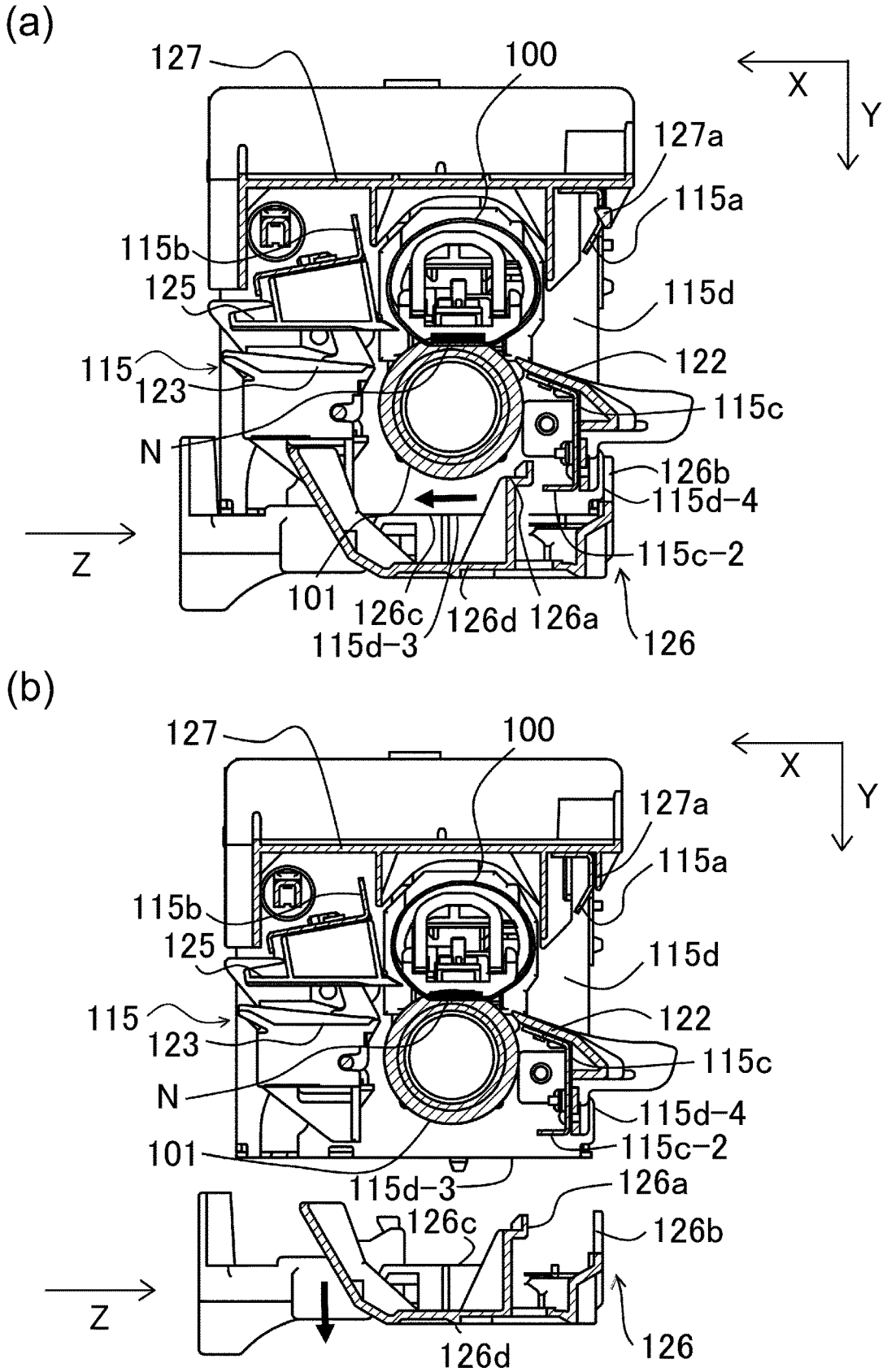

Part (a) and part (b) of FIG. 9 are a schematic sectional view of the fixing apparatus in the second embodiment, as seen while its pressure cover is being removed, and a schematic sectional view of the fixing apparatus in the second embodiment, as seen right after the removal of the pressure roller cover from the casing.

DESCRIPTION OF THE EMBODIMENTS

Embodiment 1

[Image Forming Apparatus]

Figure 1:
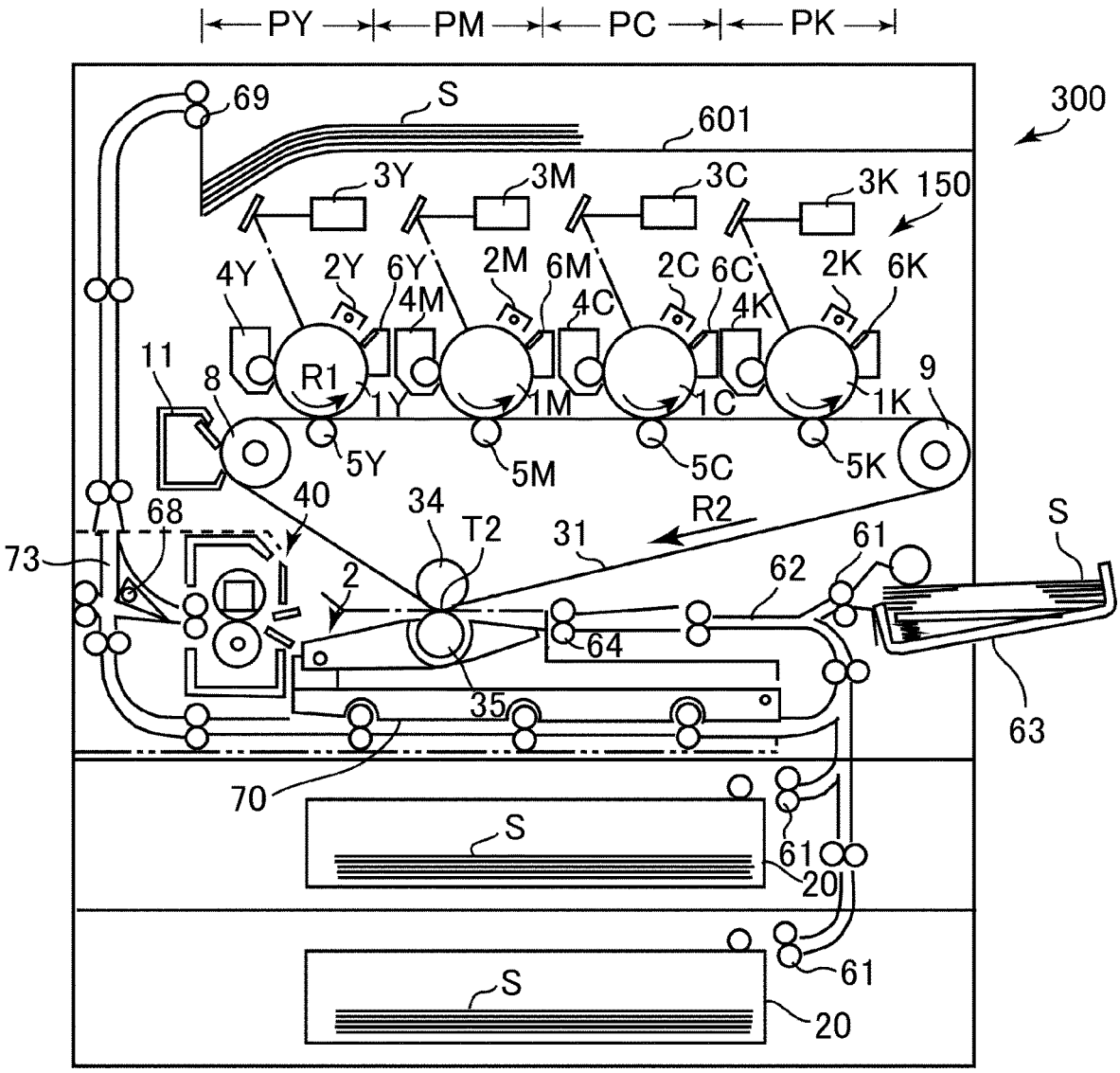
FIG. 1 is a schematic drawing of an image forming apparatus which is desirably compatible with the fixing apparatus in one of the preferred embodiments of the present invention.

Next, the fixing apparatus in this embodiment is described. To begin with, referring to FIG. 1, an image forming apparatus which is desirably compatible with the fixing apparatus in this embodiment is described. An image forming apparatus 300 shown in FIG. 1 is an electrophotographic full-color printer of the so-called tandem type. The image forming apparatus 300 has image forming sections PY, PM, PC and PK which form yellow, magenta, cyan and black toner images, respectively. It forms a toner image on a sheet S of recording medium, in response to the image formation signals transmitted thereto from an original-reading apparatus (unshown) which is in connection to the main assembly of the image forming apparatus 300, or an external device such as a personal computer which is in connection to the main assembly of the image forming apparatus. As the material for the sheet S of recording medium, ordinary paper, plastic film, fabric, or the like may be listed.

Referring to FIG. 1, image forming sections PY, PM, PC and PK are disposed in tandem in a direction (indicated by arrow mark R) which is parallel to a direction in which an intermediary transfer belt 31 of the image forming apparatus 300 is moved, in the main assembly of the image forming apparatus 300 (which hereafter will be referred to as an apparatus main assembly). The intermediary transfer belt 31 bears the toner images transferred (primary transfer) thereto from photosensitive drums 1Y, 1M, 1C and K1, and conveys them further.

Further, the apparatus main assembly is provided with a secondary transfer inside roller 34, which is one of the rollers by which the intermediary transfer belt 31 is suspended, and a secondary transfer outside roller 35, which is positioned on the opposite side of the from the secondary transfer inside roller 34, forming a secondary transfer nip T2 in which the toner images on the are transferred onto the sheet S of recording medium. Further, the image forming apparatus 300 is provided with a fixing apparatus 40, which is on the downstream side of the pair of secondary transfer rollers (the secondary transfer inside roller 34 and the secondary transfer outside roller 35) in terms of the recording medium conveyance direction (feeding direction). By the way, in the case of this embodiment, the image formation sections PY-PK, the, tension roller 8, a driving roller 9, the secondary transfer inside roller 34, and the secondary transfer outside roller 35 make up an image formation unit 150 which is capable of forming a toner image on a sheet S of recording medium.

There is disposed a cassette 20, in which multiple sheets S of recording medium can be held, in the bottom portion of the apparatus main assembly. Sheets S in the cassette 20 are fed one by one into a sheet conveyance passage 62 by a feed roller 61 in synchronism with image formation timing. By the way, the apparatus main assembly is also provided with a manual feeder tray 63, in which multiple sheets S of recording medium are placed in layers, and from which the layered sheets S of recording medium can be fed one by one into the sheet conveyance passage 62. Moreover, the apparatus main assembly is provided with a pair of registration rollers 64, which is disposed in the sheet conveyance passage 62. As each sheet S of recording medium is fed into the sheet conveyance passage 62, it is corrected in attitude if it is askew, and also, is adjusted in timing. Then, it is sent to the secondary transfer nip T2. Registration rollers 64 are rotated in synchronism with the timing with which the toner images on the are conveyed by the.

The four image forming sections PY, PM, PC and PK of the image forming apparatus 300 are practically the same in structure except that their developing apparatuses 4Y, 4M, 4C and 4K are different in the color of the toner they store. Thus, only an image forming section PY for yellow color is described as the one that represents all four; image forming sections PM, PC, and PK are not described. There is disposed photosensitive drum 1Y in image forming section PY. The photosensitive drum 1Y is rotationally driven in the direction indicated by an arrow mark R1. There are positioned a charging apparatus 2Y, an exposing apparatus 3Y, a developing apparatus 4Y, a primary transfer roller 5Y, and a drum cleaner 6Y in the adjacencies of the peripheral surface of the photosensitive drum 1Y.

As an image forming operation is started, the peripheral surface of the rotating photosensitive drum 1Y is uniformly charged by the charging apparatus 2. Then, the uniformly charged peripheral surface of the photosensitive drum 1Y is scanned by (exposed to) the beam of laser light emitted from the exposing apparatus 3Y (laser scanner, for example). Consequently, an electrostatic latent image which is reflective of image formation signals is formed on the peripheral surface of the photosensitive drum 1Y. Then, the electrostatic latent image on the photosensitive drum 1Y is developed with the toner (developer) in the developing apparatus 4Y, into a visible image formed of toner (which hereafter will be referred to as toner image).

Then, the toner image on the photosensitive drum 1Y is transferred (primary transfer) onto the intermediary transfer belt 31, in the primary transfer section which is the nip between the, and the primary transfer roller 5Y which is on the opposite side of the from the photosensitive drum 1Y. During the primary transfer, the primary transfer voltage is applied to the primary transfer roller 5Y. By the way, a minute amount of toner which is remaining on the peripheral surface of photosensitive drum 1Y after the primary transfer is removed by the drum cleaner 6Y.

Operations such as those described above can be sequentially carried out in each of yellow, magenta, cyan, and black image forming sections PY-PK, to form four toner images which are different in color, on the. If necessary, it is possible to form a monochromatic image, or an image of a desired color, by layering two or more toner images which are different in color. Meanwhile, the sheets S of recording medium in cassette 2, or on the manual feeder tray 63, are conveyed one by one toward the secondary transfer nip T2 in synchronism with the progression of the toner image formation. Then, while a sheet S of recording medium moves through the secondary transfer nip T2, the secondary transfer voltage is applied to the secondary transfer roller 35, whereby the toner image on the is transferred onto the sheet S. By the way, the secondary transfer residual toner, or the minute amount of toner remaining on the intermediary transfer belt 31 after the passage of the sheet S through the secondary transfer nip T2, is removed from the intermediary transfer belt 31 by a belt cleaner 11.

After the transfer of the toner image(s) from the onto a sheet S of recording medium, the sheet S is conveyed toward the fixing apparatus 40. The fixing apparatus 40 fixes the toner image on a sheet S of recording medium to the sheet S. More specifically, sheet S is conveyed through the fixing apparatus 40. While the sheet S is conveyed through the fixing apparatus 40, remaining pinched by the fixing apparatus 40, heat and pressure are applied to the sheet S and the toner image thereon. Consequently, the toner image becomes fixed to the sheet. The fixing apparatus 40 in this embodiment will be described later in detail (FIGS. 2-5).

In a case where the image forming apparatus 300 is the single-sided mode for forming a toner image on only one of the two surfaces of a sheet S of recording medium, the sheet S is guided into a sheet conveyance passage 73 after the fixation of the toner image by the fixing apparatus 40. Then, the sheet S is discharged into a discharge tray 601 by a pair of discharge rollers 69. On the other hand, in a case where the image forming apparatus 300 is in the two-sided mode for forming a toner image on both surfaces of the sheet S, the sheet S is conveyed into the conveyance passage 73 after the fixation of a toner image on one of its two surfaces. Then, the sheet S is conveyed backward (switch-back), being thereby put upside down. Then, it is conveyed toward the pair of registration rollers 64 through a two-side mode conveyance passage 70. Then, it is put through the same processes as those through which it was when the image forming apparatus 300 is in the one-sided mode, to form a toner image on the other surface of the sheet S. Then, it is guided into the conveyance passage 73, and discharged into the discharge tray 601 by the pair of discharge rollers 69.

[Fixing Apparatus]

Figure 2:
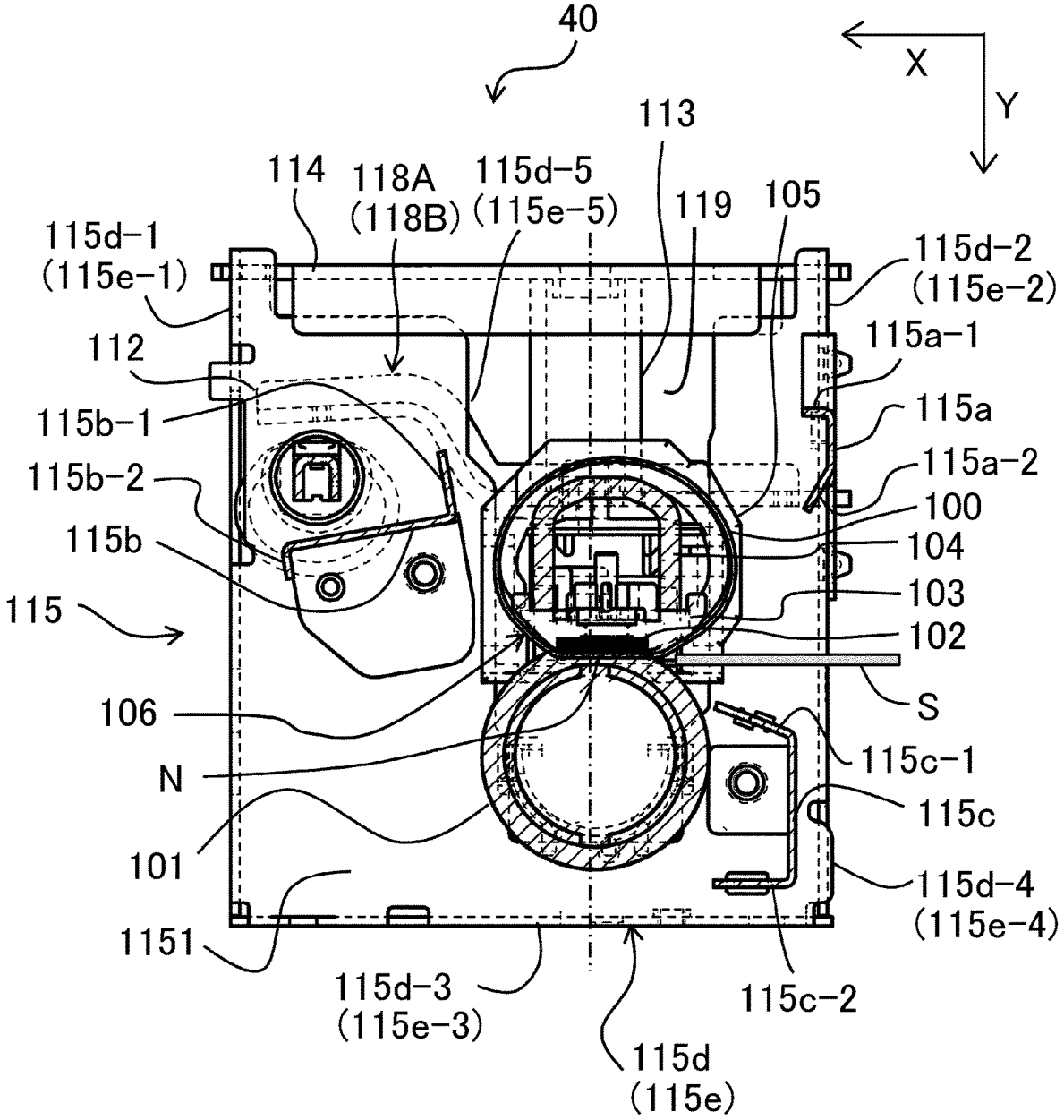
FIG. 2 is a schematic drawing of the fixing apparatus in the first embodiment of the present invention

Next, referring to FIGS. 2 to 5, the fixing apparatus 40 in this embodiment of the present invention is described. FIG. 2 is a perspective view of the fixing apparatus 40 as seen from the first side board 115*d* side, in the direction parallel to the widthwise direction of the fixing apparatus 40. By the way, in FIG. 5, the distance between the first and second side boards 115*d* and 115*e*, in the adjacencies of the film guide 105, on the upstream side of the fixing apparatus 40 in terms of the recording medium conveyance direction, and that on the downstream side, are shown by a single-dot chain line A and a dotted line B, respectively. Hereinafter, in this specification, the "widthwise" direction (lengthwise direction) means the direction which is inter-sectional to the direction in which a sheet S of recording medium is conveyed through the fixation nip (fixing nip) N. In other words, it means the direction which is parallel to the rotational axis of the pressure roller 101.

The fixing apparatus 40 is an image heating apparatus of the so-called film heating type. Referring to FIG. 2, roughly speaking, the fixing apparatus 40 has: a film unit 106 which has a fixation film 100; a pressure roller 101; a pair of pressure application mechanisms (118A and 118B); and a casing 115 to which the preceding components are attached). In this embodiment, the casing 115 comprises the first side board 115*d*, the second side boards 115*e*, the first stay 115*a*, the second stay 115*b*, and the third stay 115*c*, which are formed of a metallic substance such as SUS (stainless steel) and Al (Aluminum).

[Pressure Roller]

The pressure roller 101 is the second rotational member of the fixing apparatus 40. Its axle is rotatably supported by a pair of bearings 116 (FIG. 3), at its lengthwise ends, one for one, in terms of the widthwise direction. The pair of bearings 116 are fixed to the first and second side boards 115*d* and 115*e*, one for one. The pressure roller 101 is an elastic roller. It comprises: a metallic core formed of such a metallic substance as SUS (stainless steel), SUM (sulfur and sulfur compound free-machining steel); an elastic layer such as an elastic solid rubber layer, an elastic sponge rubber layer, an elastic foamed rubber layer, formed on the peripheral surface of the metallic core in a manner to wrap the metallic core. The elastic solid rubber layer is formed of heat resistant rubber such as silicone rubber and fluorine rubber, for example. The elastic sponge rubber layer is formed by causing silicon rubber to foam to make the elastic layer thermally more insulative. Elastic foam rubber is formed by dispersing hollow filler (micro-balloons, or the like) in silicone rubber to make silicone rubber more effective as thermally insulative material. By the way, the pressure roller 101 may be provided with a release layer which is formed of perfluoroalkoxy (PFA), polytetrafluoroethylene (PTFE), or the like), and which is placed on the peripheral surface of the elastic layer.

The pressure roller 101 forms the fixation nip N by being placed in contact with the outward surface of the fixation film 100. As the pressure roller 101 is rotated in the preset direction by a combination of unshown motor, driving gears, etc., the rotational force from the pressure roller 101 is transmitted to the fixation film 100 by the friction in the fixation nip N. That is the endless fixation film 100 is rotationally driven by the pressure roller 101 (so-called pressure roller driving method). After the formation of a toner image on a sheet S of recording medium by the image formation unit 150 (FIG. 1), the sheet S is conveyed (in direction indicated by arrow mark X) while being pressed in the fixation nip N which the combination of the pressure roller 101 and fixation film 100 forms.

In this embodiment, as the pressure roller 101 is rotationally driven, the fixation film 100 is rotationally driven by the pressure roller 101, while being heated by a heater 102. After the formation of a toner image on a sheet S of recording medium by the image formation unit 150 (FIG. 1), the sheet S is conveyed to the fixation nip N while the temperature of the holder 101 is kept at a target level. Then, while the sheet S is conveyed through the fixation nip N, remaining pinched by the combination of the fixation film 100 and the pressure roller 101, heat is applied to the sheet S by the heater 102, through the fixation film 100 which is heated by the heater 102. Consequently, the toner image on the sheet S becomes fixed to the sheet S.

[Film Unit]

Next, a film unit 106 is described. It is held to the first and second side boards 115*d* and 115*e* in such a manner that it can be moved toward the pressure roller 101 by the pair of pressure application mechanisms (118A and 118B), which will be described later in detail. The film unit 106 has: the fixation film 100; a non-rotational frame disposed on the inward side of the loop which the fixation film 100 forms; a heater holder 103; a heater 102; and a film guide 105.

[Fixation Film]

The fixation film 100 is the first rotational member of the fixing apparatus 40. It is an endless (cylindrical), flexible, thin, and heat resistant film. The substrate of the fixation film 100 is formed of heat resistant resin such as polyimide, polyamide-imide, PEEK (polyetheretherketone), or a heat resistant and highly heat conductive metallic substance such as SUS and Al. In a case where the substrate is formed of a resinous substance, the resinous substance may be dispersed with highly heat conductive particles such as alumina to improve the fixation film 100 in thermal conductivity. From the standpoint of ensuring that the fixation film 100 is strong and durable, the fixation film 100 needs to be no less than 100 μm in overall thickness. From the standpoint of ensuring that the fixation film 100 easily releases a sheet S of recording medium, its surface layer (release layer) is desired to be formed of one or mixture of such a fluorine resin as PTFE (tetrafluoroethylene), and PVDF (polyvinylidenefluoride, and a heat resistant resin such as a silicone resin. In this embodiment, the surface layer of the fixation film 100 is formed of such material that contains at least PTFE and PFA (copolymer of tetrafluoroethylene and perfluoroalkyl-vinylether), and its overall thickness is no less than 100 μm and no more than 200 μm.

[Film Guide]

The fixation film 100 is fitted around a frame 104 in such a manner that it is rotatable and removable. It is regulated in its widthwise movement by the pair of film guides 105 located at the widthwise ends of the fixation film 100. By the way, the heater holder 103 and the frame 104 are attached to the film guides 105, being therefore on the inward side of the loop the fixation film 100 forms, and are non-rotational.

Figure 4:
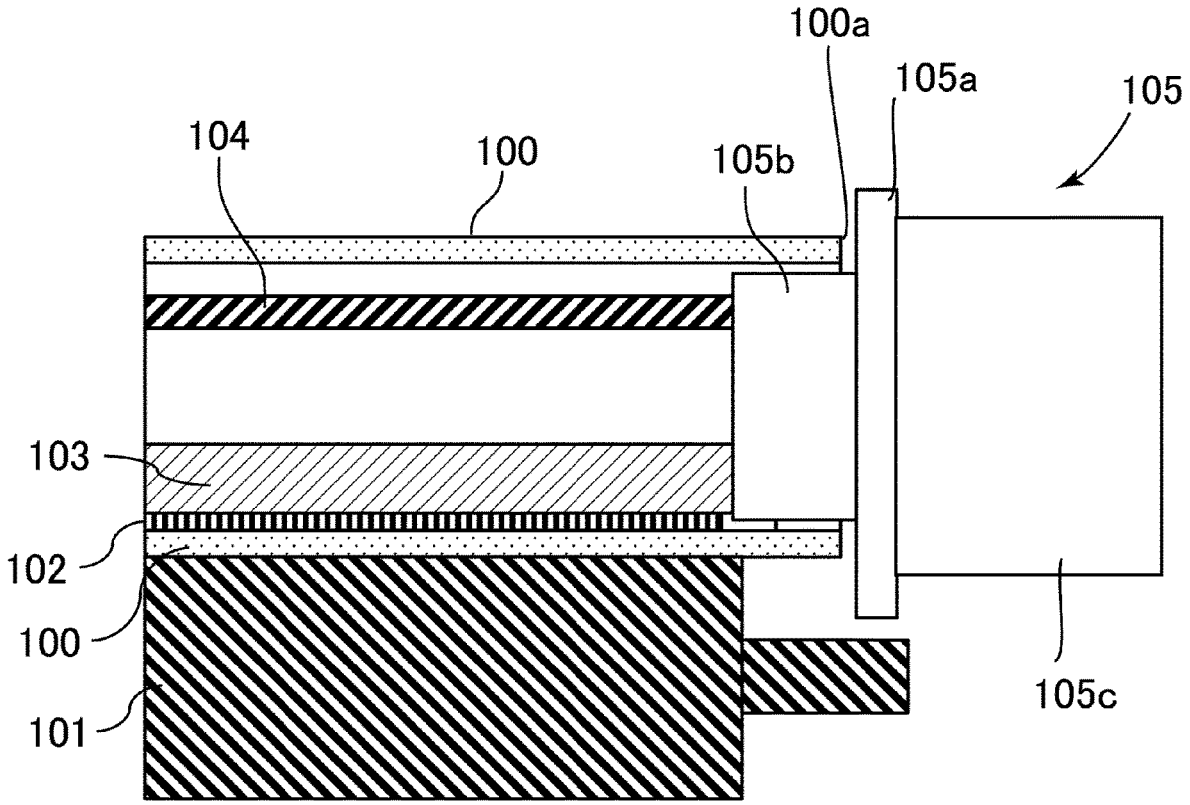
FIG. 4 is a sectional view of the film guide of the fixing apparatus in the first embodiment.

Each film guide 105, which is the first supporting member of the film unit 106, is a regulating member with which the film unit 106 is provided to regulate the fixation film 100 in its widthwise movement, and also, in its shape at a plane which is perpendicular to the widthwise direction. It may be sometimes referred to as a flange. Referring to FIG. 4, the film unit 106 has an edge regulating portion 105*a*, an inward surface regulating portion 105*b*, and a pressure bearing portion 105*c*. The edge regulating portion 105*a* is for regulating the fixation film 100 in the movement parallel to the widthwise direction of the fixation film 100. That is, the edge regulating portions 105*a* remain in contact with the edges (edge surface) 100*a* of the fixation film 100, one for one, whereby preventing the widthwise deviation (so-called widthwise shift) of the fixation film 100. The film regulating inside member 105*b* supports the fixation film 100 from the inward side of the loop which the fixation film 100 forms. It is provided to guide the fixation film 100 from within the film loop, as the fixation film 100 is rotated. The pressure bearing portion 105*c* is for bearing the pressure from the pair of pressure application mechanisms (118A and 118B in FIG. 2). It is positioned on the opposite side of the edge regulating portion 105*a* from the film regulating inside member 105*b*, with the edge regulating portion 105*a* being sandwiched between itself and film regulating inside member 105*b*.

Returning to FIG. 2, the film guide 105 is fitted in a slot 115*d*-5 of the first side board 115*d*, and a slot 115*e*-5 of the second side board 115*e*, being thereby supported by the first and second side boards 115*d* and 115*e* in such a manner that it is allowed to move toward the pressure roller 101. Thus, as the film guide 105 catches the pressure applied thereto by the pressure application mechanisms (118A and 118*b*) by way of the pressure bearing portion 105*c* FIG. 4) described above, it moves toward the pressure roller 101, following the slots 115*d*-5 (or 115*e*-5). Consequently, the fixation film 100 and the pressure roller 101 are made to contact each other, and press on each other, forming the fixation nip N.

(Film Supporting Frame)

Referring to FIG. 2, the film supporting frame 104 is a rigid member formed of a metallic substance, for example. It extends in parallel to the widthwise direction of the fixation film 100. It is roughly U-shaped in cross-section, being open on the pressure roller 101 side. The film supporting frame 104 is fixed to the abovementioned film guide 105 by its widthwise ends.

[Heater Holder]

The heater holder 103 is formed of such a resinous substance as liquid polymer and phenol resin that is highly heat resistant and highly adiabatic. Not only does it hold the heater 102, but also, guides the fixation film 100. The lower is the heater holder 103 in thermal conductivity, the less it is in the amount by which it robs the heater 102 of heat, being therefore capable of more efficiently conduct heat to the fixation film 100. Thus, it is desired that the material for the heater holder 103 contains such fillers as glass balloons and silica balloons. The heater holder 103 is provided with a groove in which the heater 102 can be fitted to be held by the heater holder 103. The groove is on the opposite side (fixation nip N side) from the film supporting frame 104, and extends in the direction parallel to the widthwise direction of the fixation film 100.

As the fixation film 100 is rotated, the heater 102 held by the heater holder 103 heats the fixation film 100 by being placed in contact with the inward surface of the fixation film 100. Thus, while a sheet S of recording medium is moved through the fixation nip N, the heat from the heater 102 is conducted to the sheet S through the fixation film 100. Consequently, the toner image on the sheet S is melted by the heat. Then, it becomes fixed to the sheet S as it cools down. In order to prevent the problem that while the fixation film 100 is in contact with the pressure roller 101, the heater holder 103 bows, the heater holder 103 is prevented by the film supporting frame 104 from bowing. By the way, the inward surface of the fixation film 100 is coated with heat resistant lubricant such as fluorine or silicone grease, in order to reduce the film unit 106 in the friction between the inward surface of the fixation film 100 and the heater holder 103 to prevent the friction from interfering with the rotation of the fixation film 100.

[Heater]

The heater 102 is a heating means. It is a ceramic heater, for example. In this embodiment, the heater 102 is provided with an unshown heat generating member, the length of which is the same as, or greater than, the width of a widest sheet S of recording medium conveyable through the fixing apparatus 40. The surface of the heater 102, which faces the inward surface of the fixation film 100, is covered with a layer of polyimide, for example, to reduce the film unit 106 in the friction between fixation film 100 and the heater 102, which in turn can reduce the fixing apparatus 40 in the amount of torque necessary to rotate the fixation film 100, and also, in the amount by which the fixation film 100 is worn by the friction.

[Pressure Application Mechanism]

Next, the pair of pressure application mechanisms (118A, 118B) are described. Each of the pressure application mechanisms (118A, 118B) is a pressure applying means. It has a casing 115 which comprises the first side board 115*d* and the second side board 115*e*, which are the same in structure and can be independently adjusted in application pressure from each other. Thus, the pressure application mechanism 118A is described as the one that represents both the first side board 115*d* and the second side board 115*e*.

Figure 3:
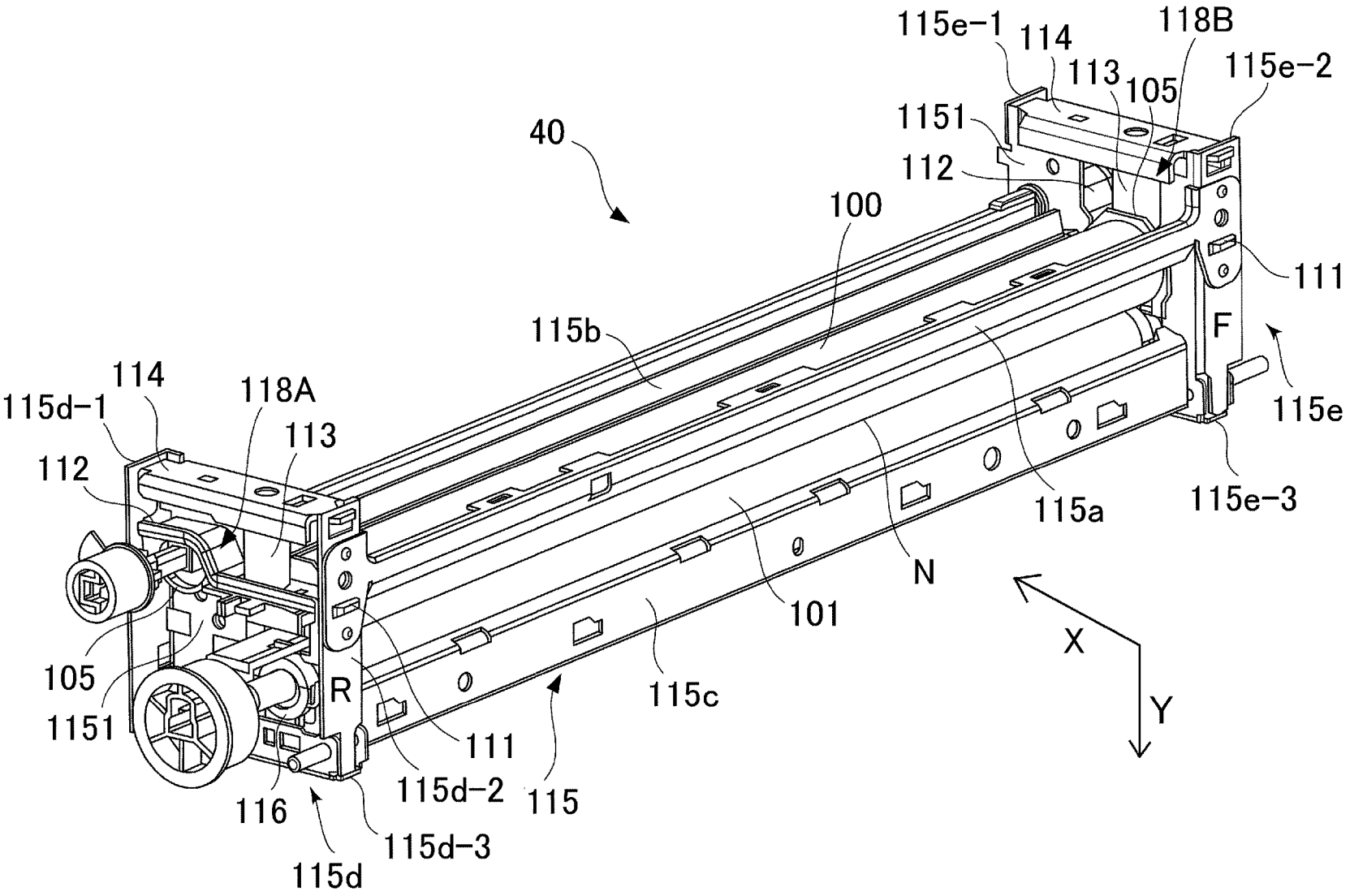
FIG. 3 is a perspective view of the fixing apparatus in the first embodiment.

The pressure application mechanism 118A has: a pressure application lever 112 which is pivotally movable; and a pressure application spring 113 which is a pressure generating means. Referring to FIG. 3, the pressure application lever 112 is supported by a portion 115*d*-2 of the first side board 115*d* in such a manner that it can be pivotally moved about its pivot 111 (base portion). It extends from the pivot 111 side toward the film guide 105 in the direction parallel to the recording medium conveyance direction (direction indicated by arrow mark X) in such a manner that it contacts the film guide 105 (portion 105*d* (FIG. 4), precisely speaking). When the pressure application lever 112 is kept in contact with the portion 105*d* of the film guide 105, the pressure application spring 113 keeps the pressure application lever 112 pressed (in direction indicated by arrow mark Y). In this embodiment, the pressure application mechanism 118A is provided with an auxiliary pressure applying member 114, which is positioned in a manner to bridge between the portion 115*d*-1 of the first side board 115*d*, and the portion 115*e*-1 of the second side board 115*e*. The pressure application spring 113 is attached to the pressure application spring 113 by one end, and the pressure application lever 112 by the other end. Thus, the pressure from the pressure application spring 113 is applied to the film guide 105 by way of the pressure application lever 112.

The pressure from the above described pressure application mechanism 118A acts on the fixation film 100 by way of the film guide 105, the film supporting frame 104, and the heater holder 103, whereby the fixation film 100 is pressed on the pressure roller 101. By the way, in order to prevent the problem that a sheet S of recording medium becomes askew while it is conveyed through the fixation nip N, remaining pinched between the fixation film 100 and the pressure roller 101 (while sheet S remains pressed by the from the pressure application mechanism (118A, 118B)), it is necessary that the fixation film 100 and the pressure roller 101 are kept aligned with each other (in parallel to each other) at a preset level.

[Casing]

Next, the casing 115 of the fixing apparatus 40 in this embodiment is described. The casing 115 in this embodiment is different from any of conventional ones, in that it does not have a bottom board. Instead, it has the first stay 115*a* (first stay), second stay 115*b* (second stay), and third stay 115*e* (third stay), by which the first and second side boards 115*d* and 115*e* are supported in such a manner that a preset amount of gap is maintained between the two boards 115*d* and 115*e* in terms of the widthwise direction.

Figure 5:
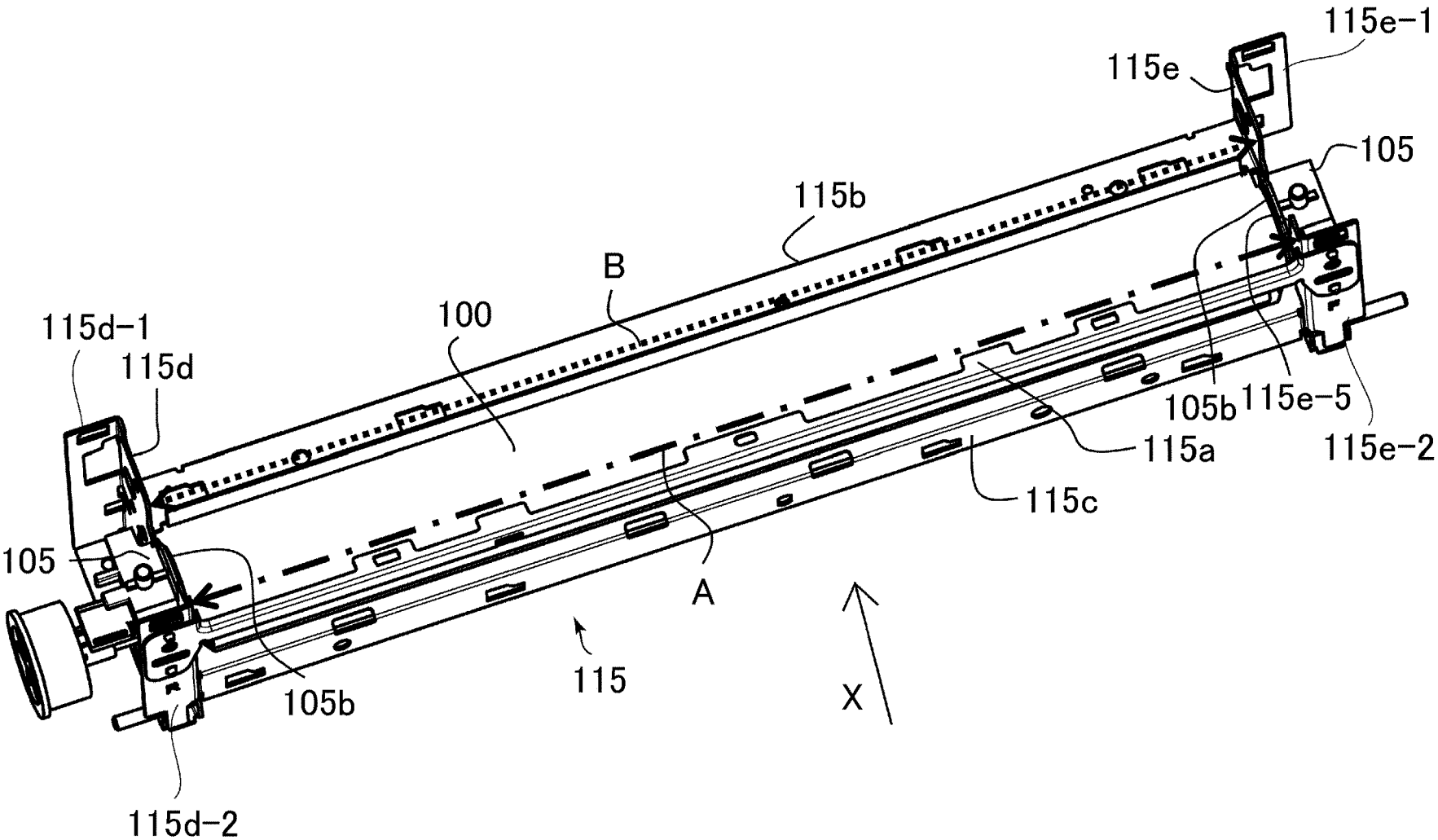
FIG. 5 is an external perspective view of the casing of the fixing apparatus in the first embodiment.

Referring to FIGS. 3 and 5, the first side board 115*d* has portions 115*d*-1 and 115*d*-2, which were formed by bending outward the end portions of the first side board 115*d* in the recording medium conveyance direction (indicated by arrow mark X). Similarly, the second side board 115*e* has portions 115*e*-1 and 115*e*-2, which were formed by bending outward the end portions, in terms of the recording medium conveyance direction, of the second side board 115*e*.

Referring to FIG. 2, the fixation nip N has a preset dimension (width) in terms of the sheet conveyance direction. The first stay 115*a* is on the upstream side, in terms of the recording medium conveyance direction, of a line which is perpendicular to the line which coincides with the center, in terms of the recording medium conveyance direction, of the fixation nip N, and also, on the upstream side (fixation film side), in terms of the pressing direction, on the above-mentioned tangential line. It is fixed to the first and second side boards 115*d* and 115*e*. The second stay 115*b* is fixed to the first and second side boards 115*d* and 115*e*, on the downstream side, in terms of the recording medium conveyance direction, of the above described perpendicular line, and also, on the upstream side (fixation film side), in terms of the pressing direction, of the above described tangential line.

More concretely, the second stay 115*b* is fixed to the first side board 115*d* by its end, in terms of the widthwise direction, and to the second side board 115*e* by the other end in terms of the widthwise direction, respectively, with small screws or the like. In comparison, the first stay 115*a* is fixed to the portion 115*d*-2 of the first side board 115*d*, by one end, in terms of the widthwise direction, and also, is fixed to the portion 115*e*-2 of the second side board 115*e* by the other end, with small screws, from the upstream side in terms of the recording medium conveyance direction. In other words, the second stay 115*b* is positioned in such a manner that to overlap with the holding portion 1151 which holds the film guide 105 and the bearings 116 on the second side board 115*e* side. On the other hand, the first stay 115*a* is positioned at one end of the holder portion 1151, as seen from the widthwise direction.

This occurs because, in this embodiment, the pivot portion 111 of the above described pressure application lever 112 is supported by the portion 115*d*-2 of the first side board 115*d* and the portion 115*e*-2 of the second side board 115*e* (FIG. 3). In this case, as the pressure application lever 112 is pivoted to press the film guide 105, such a force that works in the direction to press the portions 115*d*-2 and 115*e*-2, in the direction parallel to the recording medium conveyance direction, by way of the pivot 111. Therefore, the first side board 115*d* and second side board 115*e* tend to deform in the recording medium conveyance direction (inward). In order to prevent this phenomenon, the first stay 115*a* is positioned at one end, in terms of the widthwise direction, of the supporting portion 1151, and is fixed to the first side board 115*d* with small screws or the like from the upstream side in terms of the recording medium conveyance direction. By the way, referring to FIG. 3, the first stay 115*a* is shaped so that a part of each of its widthwise end portions remains in contact with the edge of the portion 115*e*-2 and the edge of the portion 115*e*-2. Thus, the first stay 115*a* can contribute to prevent the first side board 115*d* and second side board 115*e* from deforming in the widthwise direction.

By the way, from the standpoint of making it easier to assemble the fixing apparatus 40, the side boards 115 are formed so that they look U-shaped in cross-section. Therefore, the fixation film 100, or the first rotational member, and the pressure roller 101 can be easily attached to the pair of side boards 115, in the pressing direction. Forming the side boards 115 so that its cross-section looks like a letter U makes it easier to assemble the fixing apparatus 40. However, the fixation film 100 and the pressure roller 101 are installed in the pressing direction (indicated arrow mark Y) in FIG. 2. Therefore, there is provided a slot 119 for allowing the side boards 115 to be U-shaped in cross-section, on the upstream side of the fixation nip N. Therefore, in terms of the pressing direction the upstream side of the fixation nip N is likely to deform and/or twist. Thus, the first stay 115*a* and second stay 115*b* are positioned on the upstream side of the fixation nip N in terms of the pressing direction, and also, on the upstream and downstream sides of the fixation nip N in terms of the conveyance direction. Thus, the fixation film 100 and pressure roller 101 are likely to remain aligned with each other at a preset level.

On the other hand, referring to FIG. 2, the third stay 115*c* is positioned on the upstream side of the above described perpendicular line, in terms of the recording medium conveyance direction, and also, on the downstream side (pressure roller side) of the above described tangential line, in terms of the pressing direction, being fixed to the first side board 115*d* and second side board 115*e*. In this embodiment, the third stay 115*c* is positioned on the upstream side of the fixation nip N in terms of the recording medium conveyance direction, like the first side board 115*d* and second side board 115*e*. Thus, it is possible for the third stay 115*c* to guide the leading end of a sheet of recording medium to the fixation nip N as the sheet S is conveyed to the fixation nip N. Moreover, the third stay 115*c*, is fixed to the first side board 115*d* by its one end, in terms of the widthwise direction, and also, to the second side board 115*e* by the other end, in terms of the widthwise direction, and is fixed thereto with small screws or the like from the widthwise direction (FIGS. 3 and 5). That is, as seen from in the widthwise direction, the third stay 115*c* is positioned so that it overlaps with the holding portion 1151 of the first side board 115*d* and second side board 115*e*. By the way, with reference to the surface of the sheet of paper on which FIG. 2 is drawn, the first, second, and third stays 115*a*, 115*b*, and 115*c* do not align with each other in any direction. That is, when an arbitrary straight line is drawn, these three stays 115*a*, 115*b*, and 115*c* are not positioned on the arbitrary straight line.

The first stay 115*a*, second stay 115*b*, and third stay 115*c* are bent in such a manner that bending provide them with rigidity. That is, referring to FIG. 2, the first stay 115*a* has a sections 115*a*-1 and 115*a*-2; the second stay 115*b*, sections 115*b*-1 and 115*b*-2; and the third stay 115*e* has sections 115*c*-1 and 115*c*-2. Thus, the first stay 115*a*, second stay 115*b*, and third stay 115*c* are less likely to deform than the first, second, and third stays which are not bent in the above described manner, when the film guide 105 is subjected to the pressure from the pressure application mechanisms (118A, 118B).

As described above, in this embodiment, the pair of side boards, more specifically, the first and seconds side boards 115*d* and 115*e* are positioned relative to each other by the three stays (115*a*, 115*b*, and 115*c*) in such a manner that they face each other with the presence of a preset distance between them in terms of the widthwise direction. More specifically, in terms of the vertical direction, the first and second stays 115*a* and 115*b* are positioned on the fixation film 100 side, with reference to the fixation nip N, whereas the third stay 115*c* is positioned on the pressure roller 101 side. In terms of the recording medium conveyance direction, the first and second stays 115*a* and 115*b* are positioned on the upstream and downstream sides of the fixation nip N, and the third stay 115*c* is positioned on the upstream side of the fixation nip N.

Since the first side board 115*d* and second side board 115*e* are supported at the three points described above, it is possible to prevent the problem that as the film guide 105 is subjected to the pressure from the pressure application mechanism (118A, 118B), the first side board 115*d* and second side board 115*e* deform and/or twist. That is, even if the film guide 105 is subjected to the pressure from the pressure application mechanism (118A, 118B), the distance between the first side board 115*d* and second side board 115*e* remains roughly the same at a preset value not only on their upstream side in terms of the recording medium conveyance direction, but also, on the downstream side (in FIG. 5, A_B). Further, the edge regulating portions 105*a* (FIG. 4) of the pair of film guides 105 located at the edges of the fixation film 100 are kept roughly in parallel to each other.

That is, the fixing apparatus 40 in this embodiment is simple in structure, and yet, can keep its fixation film 100 and the pressure roller 101 aligned to each other, at a preset level. That is, even when an operator installs the fixation film 100 and the pressure roller 101, and presses the fixation film 100 upon the pressure roller 101, the first side board 115*d* and 105*e* are unlikely to deform. Therefore, in the case of this embodiment, the fixation film 100 and the pressure roller 101 can be kept aligned to each other without being provided with a bottom board such as a conventional one between the first side board 115*d* and the second side board 115*e*, and also, without the need for increasing the side boards in thickness to make them unlikely to deform. Moreover, an operator can easily install the fixation film 100 and the pressure roller 101. Further, the fixing apparatus 40 in this embodiment is advantageous in that it does not conflict with the recent desire to reduce apparatuses in weight, and also, in that it contributes to cost reduction.

Embodiment 2

Figure 6:
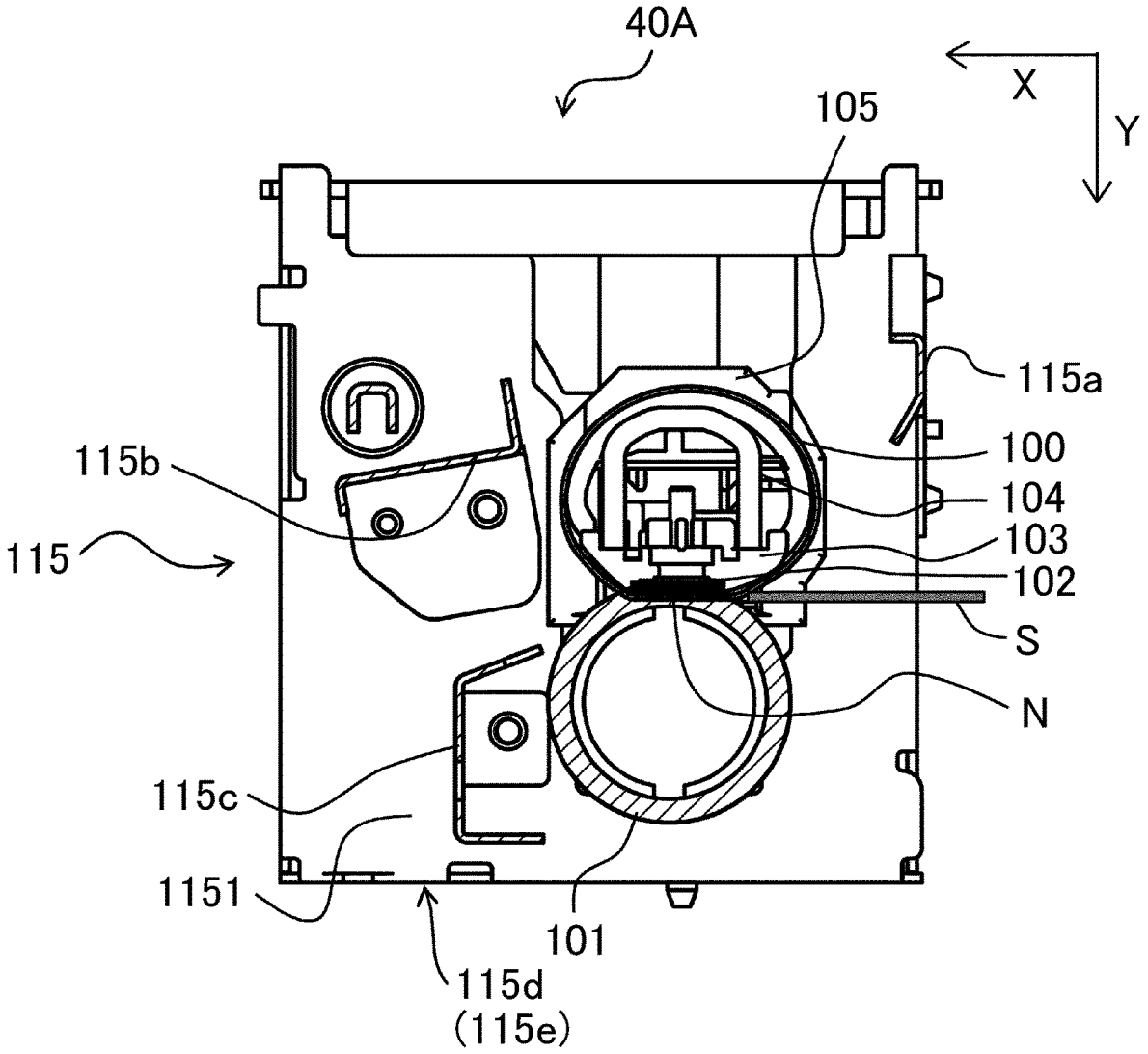
FIG. 6 is a schematic drawing of the fixing apparatus in the second embodiment of the present invention.

In the case of the fixing apparatus 40 in the first embodiment described above, the third stay 115*c* was positioned on the upstream side of the fixation nip N in terms of the recording medium conveyance direction, and also, on the downstream side of the fixation nip N in terms of the pressing direction (pressure roller side) (FIG. 2). However, the first embodiment is not intended to limit the present invention in scope in the positioning of third stay 115*c*. That is, the third stay 115*e* may be positioned on the downstream side of the fixation nip N in terms of the recording medium conveyance direction, and also, on the downstream side of the fixation nip N in terms of the pressing direction (pressure roller side). Shown in FIG. 6 is the fixing apparatus 40A in the second embodiment of the present invention, like the one described above. By the way, the fixing apparatus 40A in the second embodiment is practically the same in structure as the fixing apparatus 40 in the first embodiment (FIG. 2) except for the positioning of the third stay 115*c*.

Referring to FIG. 6, the fixing apparatus 40A in the second embodiment is different from the fixing apparatus 40 in the first embodiment in that its third stay 115*c* is on the downstream side of the fixation nip N in terms of the recording medium conveyance direction, and also, on the downstream side (pressure roller side) of the fixation nip N in terms of the pressing direction. The third stay 115*c* in this embodiment is placed in contact with the first side board 115*d* by one end in terms of the widthwise direction, and to the second side board 115*e* by the other end, and is fixed to the side boards 115*d* and 115*e* with small screws from the widthwise direction.

Also in the second embodiment, the first and second side boards 115*d* and 115*e* are supported by the three stays (115*a*, 115*b* and 115*c*) in such a manner that they face each other with the presence of a preset amount of distance between them, in terms of the widthwise direction. However, on the fixation film 100 side, the three stays (115*a*, 115*b* and 115*c*) support the first and second side boards 115*d* and 115*e* at two points (upstream and downstream points) in terms of the recording medium conveyance direction. On the pressure roller 101 side, the third stay 115*c* supports the first and second side boards 115*d* and 115*b* at one point on the downstream side of the fixation nip N in terms of the recording medium conveyance direction. That is, they support the first and second side boards 115*d* and 115*b* at a total of three points. By supporting the first and second side boards 115*d* and 115*e* at three points, it is possible to prevent the problem that as the first and second side boards 115*d* and 115*e* are subjected to the pressure from the pressure application mechanism (118A, 118B) described above, they deform and/or twist. That is, the fixing apparatus 40A in the second embodiment also is simple in structure and yet, can keep its fixation film 100 and the pressure roller 101 aligned with each other at a preset level. Therefore, it can make it easier for an operator to install the fixation film 100 and the pressure roller 101. In other words, the second embodiment can provide the same effects as those provided by the first embodiment. Further, it also is advantageous in that it does not conflict with recent desire to reduce apparatuses in weight, and also, in that it can reduce a fixing apparatus in cost.

By the way, in the first and second embodiments described above, only a single third stay 115*c* is provided.

Further, the first and second side boards 115*d* and 115*e* were supported by the three stays (115*a*, 115*b*, and 115*c*). However, the first and second embodiments are not intended to limit the present invention in scope. For example, the fixing apparatus 40 in the first embodiment, and the fixing apparatus 40A in the second embodiment, may be provided with two third stays 115*e*, which are positioned on the upstream and downstream sides, in terms of the recording medium conveyance direction, and on the pressure roller 101 side, one for one. That is, the first and second side boards 115*d* and 115*e* may be supported by the first stay 115*a*, second stay 115*b*, and two third stays 115*c*, that is, a total of four stays.

[Fixation Film Cover, Pressure Roller Cover, and Side Board Cover]

By the way, in a case where the casing 115 comprises only the first side board 115*d*, second side board 115*e*, first stay 115*a*, second stay 115*b*, and third stay 115*c*, it is possible for external dusts and the like enter the fixing apparatus 40 (40A), and adhere to the fixation film 100 and the pressure roller 101. As dusts and the like adhere to the fixation film 100 and the pressure roller 101, it is difficult for a toner image to be properly fixed to a sheet S of recording medium. Thus, allowing dusts and the like to enter a fixing apparatus is undesirable.

Thus, in order to prevent external dusts and the like from entering the casing 115, and also, to make it easier for an operator to replace the fixation film 100 and/or the pressure roller 101, the fixing apparatus 40 (40A) is provided with removable fixation film cover, a removable pressure roller cover, and removable side board covers. Next, referring to FIGS. 7 to 9(*b*), these fixation film cover, pressure roller cover, and side board covers are described. By the way, FIGS. 8 to 9(*b*) are side views of the fixing apparatus 40 as seen from the first side board 115*d* side, in the widthwise direction. Further, FIG. 8 is a side view of the fixing apparatus 40 after the fitting of the casing 115 with a pressure roller cover 126. FIG. 9(*b*) is a side view of the fixing apparatus 40 after the separation of the pressure roller cover 126 from the casing 115.

Figure 7:
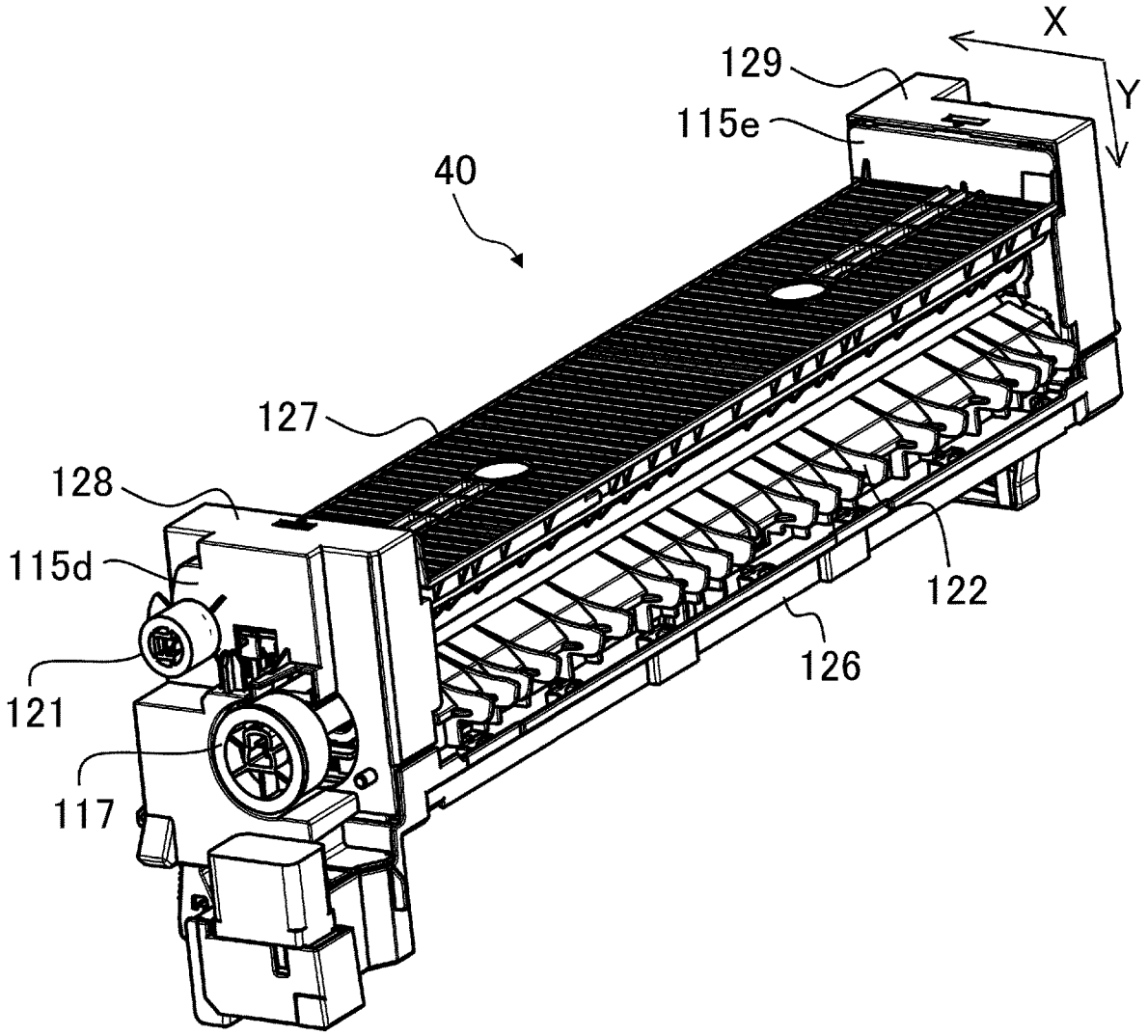
FIG. 7 is an external perspective view of the fixing apparatus in the second embodiment, after the attachment of its fixation cover, pressure application cover, and side board covers, to its casing.
Figure 8:
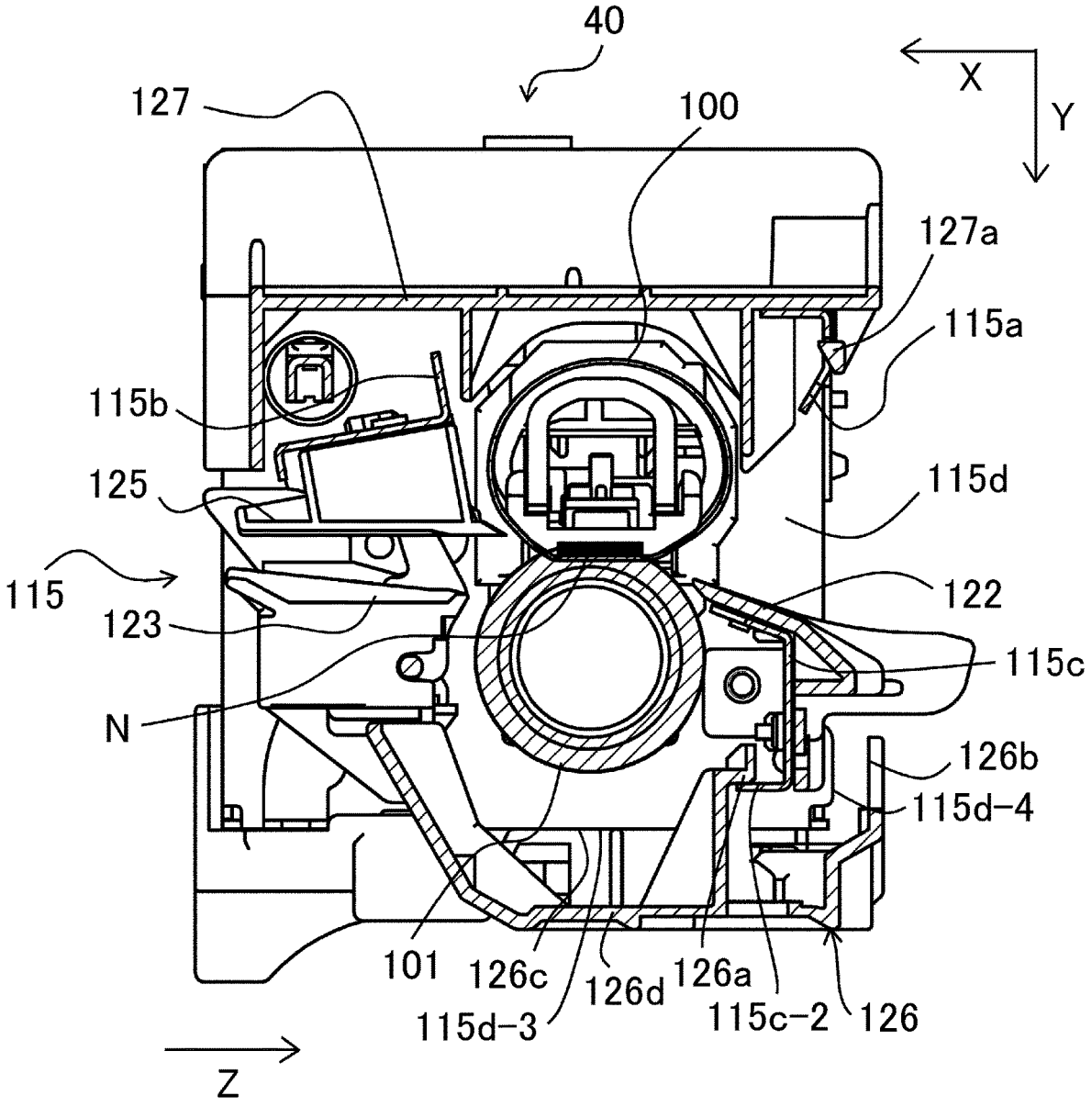
FIG. 8 is a schematic sectional view of the fixing apparatus shown in FIG. 7.

Referring to FIGS. 7 and 8, side board covers 128 and 129 are attached to the first and second side boards 115*d* and 115*e*, respectively. Not only do the side board covers 128 and 129 protect the first and second boards 115*d* and 115*e*, but also, prevent dusts from entering into the casing 115 from widthwise ends of the fixation film 100 and those of the pressure roller 101.

Not only does the fixation film cover 127 protect the fixation film 100, but also, prevents dusts and the like from entering the fixing apparatus 40, primarily from the fixation film 100 side (upstream side in terms of pressing direction). Referring to FIG. 8, the fixation film cover 127 is provided with claw-like portions 127*a*, which are located at both ends and the center in terms of the widthwise direction. These claw-like portions 127*a* are engaged with the first stay 115*a* to attach the fixation film cover 127 to the casing 115. In the case of this embodiment, the fixation film cover 127 is positioned so that it covers at least the fixation film 100 and the pressure roller 101 as seen from the pressing direction (indicated by arrow mark Y).

On the other hand, not only does the pressure roller cover 126, which is a covering member, cover the pressure roller 101 to protect the pressure roller 101, but also, prevent dusts and the like enter the fixing apparatus 40, primarily from the pressure roller 101 side (downstream side, in terms of pressing direction). Referring to FIG. 8, the pressure roller cover 126 is installed in such a manner that it is slid in the installation direction (indicated by arrow mark Z which is intersectional to the axial line of the pressure roller 101. More concretely, the pressure roller cover 126 is provided with claw-like portions 126*a*, which are in alignment in the widthwise direction. These claw-like portion 126*a* engage with bent portions 115*c*-2, with which third stay 115*c* is provided, and which are in alignment in the widthwise direction, to attach the pressure roller cover 126 to the casing 115. The claw-like portion 126, which is an engaging portion, is perpendicularly protrusive from the covering portion 126*d* of the pressure roller cover 126, which covers the printing unit 102, toward the pressure roller 101 (second rotational member side).

Further, in this embodiment, the pressure roller cover 126 has a contacting portion 126*c* and a regulating portion 126*b*, in addition to the claw-like portion 126*a* and covering portion 126*d*, which were described above. The contacting portion 126*c* are placed in contact with the first and second side boards 115*d* and 115*e* from the downstream side in terms of the pressing direction, to set the position, in terms of the pressing direction (indicated by arrow mark Y), in which the engaging claw 126*a* can engage the third stay 115*c* (more specifically, bend portion 115*c*-2). The regulating portion 126*b* comes into contact with the first and second side boards 115*d* and 115*e*, in the position in which the engaging claw 126*a* is disengaged, to prevent the engaging craw 126*a* from coming into contact with the pressure roller 101, and allowing its engaging claw 126*a* to come into the p191, in the opposite direction (indicated by arrow mark X) from installation direction (indicated by arrow mark Z).

That is, in order for an operator to replace the pressure roller 101, it is necessary for the operator to detach the pressure roller cover 126 from the casing 115, and then, attach the pressure roller cover 126 to the casing 115. In the case of a conventional fixing apparatus, the side boards are vertically attached to its bottom board (base board). Thus, the pressure roller 101 is protected by the bottom board. Therefore, there was no possibility that when the pressure roller cover 126 is attached or detached, the pressure roller cover 126 damages the surface of the pressure roller 101 by coming into contact with the pressure roller 101. In comparison, in the case of the fixing apparatuses 40 and 40A in the first and second embodiments, respectively, described above, their casing 115 comprises the first and second side boards 115*d* and 115*e*, and first, second, and the third stays 115*a*, 115*b*, and 115*c*, respectively, they do not have a bottom board. Therefore, it is possible for a part of the pressure roller cover 126 to damage the printing unit 102 by coming into contact with the pressure roller 101.

In this embodiment, therefore, the fixing apparatus 40 is structured so that the problem that when the pressure roller cover 126 is attached or detached, it comes into contact with the pressure roller 101 is prevented by the contacting portion 126*c* and regulating portion 126*d*, with which the pressure roller cover 126 is provided. Next, this structural arrangement is described with reference to FIGS. 9(*a*) and 9(*b*).

Referring to FIG. 9(*a*), as the pressure roller cover 126 is slid in the opposite direction (indicated by arrow mark X) from the installation direction (indicated by arrow mark Z), the engaging claw 126*a* disengages from the bent portion 115*c* (catching portion) of the third stay 115*c*. During this sliding of the engaging claw 126*a*, the contacting portion 126*c* of the pressure roller cover 126 remains in contact with the catch portion 115*d*-3 (or catch portion 115*e*-3 of second side board 115*e*). Then, the moment when the engaging claw 126 disengages, the regulating portion of the pressure roller cover 126 comes into contact with the protrusive portion

115*d*-4 of the first side board 115*d*, preventing thereby pressure roller cover 126 from sliding in the opposite direction from the direction (indicated by arrow mark Z) in which the pressure roller cover 126 is attached. Thereafter, the pressure roller cover 126 is movable in the pressing direction (indicated by arrow mark Y) to be detached from the casing 115, as shown in FIG. 9(*b*). By the way, the procedure for attaching the pressure roller cover 126 to the casing 115 is the reversal of the above described procedure for detaching the pressure roller cover 126.

By the way, the casing 115 may comprise an entrance guide 122, the first separation guide 125, and the second separation guide 123, which are formed of a resinous substance, in addition to the above described pressure roller cover 126, fixation film cover 127 and side board covers 128 and 129. The entrance guide 122 is supported by the third stay 115*c*. It guides a sheet S of recording medium to the fixation nip N. The first separation guide 125 is supported by the second stay 115*b*. It separates the sheet S from the fixation film 100 as the sheet S comes out of the fixation nip N. Then, it conveys the sheet S further, by rotating with the second separation guide 123. The second separation guide 123 is rotatably supported by the first and second side boards 115*d* and 115*e*, by its shaft portions (unshown lengthwise end portions). As described above, in this embodiment, the first entrance guide 122, first separation guide 125, second separation guide 123, pressure roller cover 126, fixation film cover, and side board covers 128 and 129 are attached to the casing 115.

As described above, in this embodiment, the fixing apparatus 40 is designed so that when the pressure roller cover 126 is attached or detached, the movement of the pressure roller cover 126 relative to the casing 115 is regulated by the contacting portion 126*c* and regulating portion 126*b* of the pressure roller cover 126. Thus, it is possible to attach the pressure roller cover 126 to the casing 115, or detach the pressure roller cover 126 from the casing 115, without allowing the pressure roller cover 126 to come into contact with the pressure roller 101.

Moreover, in this embodiment, as described above, it was made possible to keep the fixing apparatus 40 stable at a preset value in the distance between the two side boards, by preventing the problem that the pressure from the pressure application mechanisms (118A, 118B) causes the first side board 115*d* and the second side board 115*e* to deform and/or twist. Therefore, it is unlikely for the above described entrance guide 122, the first separation guide 125, the second separation guide 123, the pressure roller cover 126, the fixation film cover 127, the side board covers 128 and 129, the shaft engaging portion 128 to be subjected to deformative force with the pressure from the pressure application mechanism (118A, 118B). Therefore, the entrance guide 122, the first separation guide 125, the second separation guide 123, the pressure roller cover 126, the fixation film cover 127, and the side board covers 128 and 129, which are formed of a resinous substance and thin, can be employed, making it possible to reduce the fixing apparatus 40 in cost.

<Miscellanies>

By the way, in the case of the fixing apparatus 40 in the second embodiment, which was shown in FIG. 6, it is different from the fixing apparatus 40 shown in FIG. 8, in that it is designed so that the pressure roller cover 126 can be attached to the casing 115 by making the engaging portions of the pressure roller cover 126 engage with the catch portion of the third stay 115*c*, and then, sliding the pressure roller cover 126 from the opposite side from the conveyance direction. In such a case, however, the engaging portion of the pressure roller cover, and the catch portion of the third stay 115*c*, are positioned on the downstream side, instead of on the upstream side, in terms of the recording medium conveyance direction (shown in FIG. 8).

By the way, each of the above described embodiments is also compatible to a fixing apparatus which employs a fixation roller in place of the fixation film 100. Further, the application of these embodiment is not limited to a fixing apparatuses structured to heat the fixation film 100. That is, they are also compatible with a fixing apparatus which employs a pressure application film, instead of the pressure roller 101, and is structured to heat the pressure application film with a heater or the like.

According to the present invention, it is possible to keep a fixing film and a pressure roller aligned to each other at a preset level, by the employment of a simple structural arrangement.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-019121 filed on Feb. 9, 2021, which is hereby incorporated by reference herein in its entirety.

What is claimed is:

1. A fixing device comprising:

a first rotatable member;

a heating unit configured to heat said first rotatable member;

a second rotatable member contacting an outer peripheral surface of said first rotatable member, said second rotatable member forming a fixing nip, in cooperation with said first rotatable member, configured to nip and feed a recording material, and to form a fixing nip portion for fixing a toner image by application of heat and pressure;

a pair of side boards formed of a metallic substance and disposed with a space in a widthwise direction, the pair of side boards holding said second rotatable member and a slot being formed therein to movably hold said first rotatable member toward said second rotatable member; and a plurality of stay members including a first stay member, a second stay member and a third stay member configured to support the pair of side boards by being fixed to the pair of side boards;

wherein said first stay member is provided upstream of a center of said fixing nip portion with respect to a direction from said first rotatable member to said second rotatable member and upstream of the center with respect to the feeding direction, wherein said second stay member is provided upstream of the center with respect to the direction from said first rotatable member to said second rotatable member and downstream of the center with respect to the feeding direction, wherein said third stay member is provided downstream of the center with respect to the direction from said first rotatable member to said second rotatable member and at least one of upstream and downstream of the center with respect to the feeding direction, and wherein when said second rotatable member is viewed in a direction from said second rotatable member toward said first rotatable member, at least a part of said second rotatable member is not covered by said third stay member.

2. The fixing device according to claim 1, wherein said third stay member is provided downstream of the center with respect to the direction from said first rotatable member to said second rotatable member and upstream of the center with respect to the feeding direction.

3. The fixing device according to claim 1, at least one of said first stay member, said second stay member and said third stay member includes a bending portion.

4. The fixing device according to claim 1, wherein the pair of side boards include holding portions opposing to each other to hold said second rotatable member, and wherein one of said first stay member and said second stay member, and said third stay member are disposed to overlap with said holding portions as seen from the widthwise direction.

5. The fixing device according to claim 1, further comprising a cover member disposed on an opposite side to said first rotatable member across said second rotatable member with respect to the direction from said first rotatable member to said second rotatable member, and mountably provided to the pair of side boards by slidably moving in a mounting direction crossing a rotatable axis direction of said second rotatable member, wherein said cover member includes a cover portion covering and hiding said second rotatable member, an engaging portion projecting toward said second rotatable member from said cover portion and engageable with said third stay member, a contacting portion contacting the pair of side boards from downstream side of the direction from said first rotatable member to said second rotatable member to determine a position where said engaging portion is engageable with said third stay member, and a restricting portion restricting movement of said engaging member toward a direction opposite to the mounting direction so as not to contact said second rotatable member.

6. The fixing apparatus according to claim 5, wherein said engaging member is formed over along the widthwise direction of said cover member, and wherein an engaged portion to be engaged with said engaging member over along the widthwise direction is formed in said third stay member.

7. The fixing apparatus according to claim 1, wherein when an arbitrary straight line is drawn, said first stay member, said second stay member and said third stay member are not positioned on the arbitrary straight line.

8. The fixing apparatus according to claim 1, wherein said first stay member, said second stay member and said third stay member are not disposed downstream of said pressing unit with respect to the direction from said first rotatable member to said second rotatable member.

9. The fixing apparatus according to claim 1, further comprising a fixing member configured to fix said plurality of stay members to the pair of side boards.

10. The fixing apparatus according to claim 9, wherein said fixing member is a screw, wherein said plurality of stay members and said pair of side boards are provided with holes through which the screw is penetrated, respectively, and wherein said plurality of stay members are fixed to said pair of side boards by penetrating the screw though the holes.

11. The fixing apparatus according to claim 1, further comprising a cover member disposed on an opposite side to said first rotatable member across said second rotatable member with respect to the direction from said first rotatable member to said second rotatable member, wherein said cover is engageable with said third stay member.

12. The fixing apparatus according to claim 11, wherein said cover is formed of a resinous substance.

13. The fixing apparatus according to claim 1, wherein said first stay member, said second stay member and said third stay member are formed of a metallic sub stance.

14. The fixing apparatus according to claim 1, wherein an opening is provided downstream of said second rotatable member with respect to the direction from said first rotatable member toward said second rotatable member.

* * * * *